US008164624B2

(12) United States Patent
Lee

(10) Patent No.: US 8,164,624 B2
(45) Date of Patent: Apr. 24, 2012

(54) DATA CONVERTING DEVICE, METHOD THEREOF, AND LIQUID CRYSTAL DISPLAY DEVICE HAVING THE SAME

(75) Inventor: Ju Young Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1310 days.

(21) Appl. No.: 11/639,745

(22) Filed: Dec. 15, 2006

(65) Prior Publication Data

US 2007/0211008 A1 Sep. 13, 2007

(30) Foreign Application Priority Data

Mar. 7, 2006 (KR) ..... 10-2006-0021182

(51) Int. Cl.
*G09G 3/36* (2006.01)

(52) U.S. Cl. ..... 348/98; 345/99; 345/204

(58) Field of Classification Search ..... 345/204, 345/87, 90, 99, 94
See application file for complete search history.

(56) References Cited

U.S. PATENT DOCUMENTS 4,393,379 A 7/1983 Berting et al.
5,892,494 A 4/1999 Kimura et al.
6,476,879 B1 11/2002 Ho et al.
6,545,653 B1 * 4/2003 Takahara et al. ..... 345/87
2003/0197672 A1 * 10/2003 Yun et al. ..... 345/99
2005/0162364 A1 * 7/2005 Takahashi et al. ..... 345/94

FOREIGN PATENT DOCUMENTS

JP 2004-302270 10/2004
JP 2005-128488 5/2005

OTHER PUBLICATIONS

Office Action issued in corresponding Taiwanese Patent Application No. 095148641; issued Mar. 30, 2010.

Office Action issued in corresponding Japanese Patent Application No. 2006-339351, mailed Sep. 29, 2010.

* cited by examiner

*Primary Examiner* — Amare Mengistu
*Assistant Examiner* — Joseph G Rodriguez
(74) *Attorney, Agent, or Firm* — Brinks Hofer Gilson & Lione

(57) ABSTRACT

Provided are a data converting device for improving image quality, a method thereof, and an LCD device having the same. The data converting device includes a polarity signal generating part and a data varying part. The polarity signal generating part generates a polarity signal inverting polarity of a data signal in turns by a period of n fields. The data varying part differently varies data signals corresponding to respective field periods within the period of the n fields.

10 Claims, 6 Drawing Sheets

DATA CONVERTING DEVICE, METHOD THEREOF, AND LIQUID CRYSTAL DISPLAY DEVICE HAVING THE SAME

This non-provisional application claims priority under 35 U.S.C. §119(a) on Patent Application No. 21182/2006 filed in Korea on Mar. 7, 2006, filed in Korea on the entire contents of which are hereby incorporated by reference.

BACKGROUND OF THE INVENTION

1. Field of the Invention

The present invention relates to data converting, and more particularly, to a data converting device for improving image quality, a method thereof, and a liquid crystal display (LCD) device having the same.

2. Description of the Related Art

Cathode ray tubes (CRTs) have disadvantages of being heavy in weight and having a large volume. Flat panel display devices are under active development in order to overcome these disadvantages of the CRTS. The flat panel display devices include LCD devices, field emission display (FED) devices, plasma display panels (PDPs), and electro-luminescence (EL) display devices. The flat panel display devices displays an image corresponding to image signals (e.g., television image signals) received from the outside. These flat panel display devices include a panel for displaying the image corresponding to the image signals, and a driving unit for driving the panel.

The image signals are roughly classified into progressive type signals and interlace type signals depending on a displaying method.

In a progressive type displaying method, an image is displayed by image signals constituting one screen, that is, by one frame unit. Representative examples of progressive type flat panel display devices include computer monitors, PDPs, and LCD devices. Therefore, the LCD devices display image signals in a frame unit.

In an interlace type displaying method, image signals constituting one screen, that is, one frame, are divided into an odd field displaying odd horizontal lines and an even field displaying even horizontal lines. Image signals are supplied in order of the odd field and the even field to display one corresponding frame. Representative examples of these interlace type display devices include television (TV) sets. The TV sets receive interlace type image signals for a TV from a broadcasting station and directly display the interlace type image signals for the TV using the interlace type displaying method.

A broadcasting station transmits interlace type image signals for a TV. Therefore, in the case where the LCD device is used in a TV set, interlace type image signals for the TV cannot be directly displayed on the LCD device because the LCD device processes a predetermined image using the progressive displaying method.

The LCD device includes a liquid crystal (LC) panel in which a plurality of pixels displaying an image are arranged in a matrix, and a driving unit for driving the LC panel.

The LC panel includes a plurality of horizontal lines and a plurality of vertical lines. The pixels are defined by the horizontal lines and the vertical lines. Pixel electrodes are formed on the pixels, respectively. Also, red (R), green (G), and blue (B) color filters are formed on regions corresponding to the pixels.

The driving unit includes a gate driver for sequentially supplying scan signals to the horizontal lines, a data driver for a predetermined image signal to the vertical lines, and a timing controller for generating control signals for controlling the gate driver and the data driver.

The horizontal lines are sequentially driven by scan signals supplied by the gate driver. An image signal supplied from the data driver is applied to the pixels via the vertical lines, so that a predetermine image is displayed using the color filters. That is, image signals of one frame are displayed in response to the sequentially drive horizontal lines.

Therefore, the progressive displaying method is suitable for an LCD device where the horizontal lines are sequentially driven. In other words, since the horizontal lines are sequentially driven regardless of odd horizontal lines and even horizontal lines in the LCD device, the progressive displaying method is suitable.

In the case where the LCD device is used for a TV set, interlace type image signals are provided from a broadcasting station. Accordingly, it is not easy to display the interlace type image signals using a progressive type LCD device.

To solve this problem, a method for displaying interlace type image signals using an LCD device without converting the interlace type image signals into progressive type image signals has been proposed.

In detail, interlace type image signals where an odd field and an even field are repeated are supplied to an LCD device. In the odd field, actual pixel data exists only on odd horizontal lines, and does not exist on even horizontal lines. On the other hand, in the even field, actual pixel data exist only on even horizontal lines and does not exist on odd horizontal lines. Therefore, a complete one frame includes the odd field and the even field.

When an odd field is supplied, the LCD device generates dummy pixel data on the even horizontal lines using actual pixel data existing on adjacent odd horizontal lines. Accordingly, since actual pixel data exists on the odd horizontal lines in the odd field and the dummy pixel data exists also on the even horizontal lines, the odd field itself can constitute a complete one frame. Also, when an even field is supplied, the LCD device generates dummy pixel data on the odd horizontal lines using actual pixel data existing on adjacent even horizontal lines. Accordingly, since dummy pixel data exists on the odd horizontal lines in the even field and actual pixel data exists on the even horizontal lines, the even field can constitute a complete one frame. A variety of methods for generating the dummy pixel data exist. The dummy pixel data is at least smaller than the actual pixel data. Therefore, each of an odd field and an even field can be regarded as one frame. Each of the odd field and the even field will be treated as a frame in the following description.

The LCD device sequentially drives respective horizontal lines during a first frame to display pixel data in an odd field, and sequentially drives respective horizontal lines during a second frame to display pixel data in an even field. Therefore, the LCD device can directly display interlace type image signals containing the odd field and the even field.

FIG. 1A is a view illustrating pixel data in an odd field supplied using an interlace type is displayed on a liquid crystal (LC) panel, and FIG. 1B is a view illustrating pixel data in an even field supplied using an interlace type is displayed on an LC panel.

Referring to FIG. 1A, in case of an odd field, actual pixel data can be displayed on odd horizontal lines, and dummy pixel data can be display on even horizontal lines.

Referring to FIG. 1B, in case of an even field, dummy pixel data can be displayed on odd horizontal lines, and actual pixel data can be displayed on even horizontal lines.

Referring to FIG. 2, interlace type image signals are inverted and dot-inverted by a field unit in order to improve display quality.

In detail, in interlace type image signals, an odd field period and an even field period are repeated, so that an odd field and an even field are displayed. It should be noted that each of the odd field period and the even field period corresponds to one frame period.

Referring to FIG. 3, a predetermined pixel on odd horizontal lines is charged with actual pixel data of positive polarity (+) with respect to a common voltage Vcom during a first odd field (OF) period. The predetermined pixel is charged with dummy pixel data of negative polarity (−) during a first even field (EF) period. Subsequently, the predetermined pixel is charged with actual pixel data of positive polarity (+) during a second odd field (OF) period. Also, the predetermined pixel is charged with dummy pixel data of negative polarity (−) during a second even field (EF) period. In this manner, the predetermined pixels are charged with actual pixel data and dummy pixel data in turns by a field unit. As described above, since the dummy pixel data is calculated using actual pixel data on adjacent horizontal lines, an absolute value of the actual pixel data is far greater than that of the dummy pixel data. Accordingly, voltages that charge pixels on the odd horizontal lines and pixels on the even horizontal lines have an average voltage (DC voltage) of positive polarity (+) with respect to the common voltage Vcom as the odd field period and the even field period repeat. A DC voltage having positive polarity (+) is applied to the pixel, resulting in a serious afterimage.

To solve this problem, polarity of pixel data is inverted by a two-field unit (an odd field and an even field) as illustrated in FIG. 4.

In detail, referring to FIG. 5, predetermined pixels on odd horizontal lines are charged with actual pixel data of positive polarity (+) with respect to the common voltage Vcom during a first odd field period. The predetermined pixels are charged with dummy pixel data of positive polarity (+) during a first even field period. The predetermined pixels are charged with actual pixel data of negative polarity (−) during a second odd field period. The predetermined pixels are charged with dummy pixel data of negative polarity (−) during a second even field period. Polarity of pixel data is inverted by a two-field unit in this manner.

In this case, actual pixel data of positive polarity (+) charged during the first odd field period and dummy pixel data of positive polarity (+) charged during the first even field period, and actual pixel data of negative polarity (−) charged during the second odd field period and dummy pixel data of negative polarity (−) charged during the second even field period, are symmetric with respect to the common voltage Vcom, these data cancel each other to become a zero average value (DC voltage). Therefore, a DC voltage is not applied to the pixel and thus an afterimage is not generated.

However, although an afterimage is prevented by inverting polarity of pixel data by a two-field unit, flicker may be constantly generated. That is, referring to FIG. 6, predetermined pixels on the horizontal lines are charged with actual pixel data of positive polarity (+) during a first odd field period. Subsequently, the predetermined pixels are charged with dummy pixel data of positive polarity (+) during a first even field period. In this case, since all of the pixel data have the same polarity of (+) during the first odd field period and the first even field period, all of the pixels charged with the actual pixel data during the first odd field period are not discharged, but rather a portion of a DC voltage remains. Therefore, the residual DC voltage during the first odd field period is added to the dummy pixel data of the first even field period, so that the pixel is charged with dummy pixel data greater than the dumpy pixel data during the first even field period. The above process is repeated every even field period. Therefore, since a desired image is not displayed during an even field period under influence of a residual DC voltage in an odd field period, flicker is generated. This flicker is particularly serious in the case where pixel data of the same brightness is displayed by each field unit. For example, in the case where both a first odd field and a first even field are white, a pixel data value in the first even field increases due to a DC voltage existing on horizontal lines of the first odd field. Accordingly, not only is the same white not realized on the first odd field and the first even field, but also serious flicker is generated.

SUMMARY OF THE INVENTION

Accordingly, the present invention is directed to a liquid crystal display device that substantially obviates one or more problems due to limitations and disadvantages of the related art.

A data converting device is provided that includes a polarity signal generating part that generates a polarity signal inverting polarities of data signals in turns by a period of at least two fields. The device includes a data varying part that varies data signals differently corresponding to respective field periods within the period of the at least two fields.

In another aspect, there is provided a data converting method that includes generating a polarity signal for inverting polarities of data signals in turns by a period of at least two fields; and varying the data signals differently corresponding to respective field periods within the period of the at least two fields.

In another aspect, there is provided a liquid crystal display device that includes a data converting unit that varies data signals differently corresponding to respective field periods within a period of at least two fields in response to a polarity signal for inverting polarity in turns by the period of the at least two fields. The device also includes a liquid crystal panel including a plurality of first lines and a plurality of second lines arranged in a matrix. A gate driver supplies scan signals to the first lines and a data driver supplies an analog voltage that corresponds to the differently varied data signals to the second lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 7:
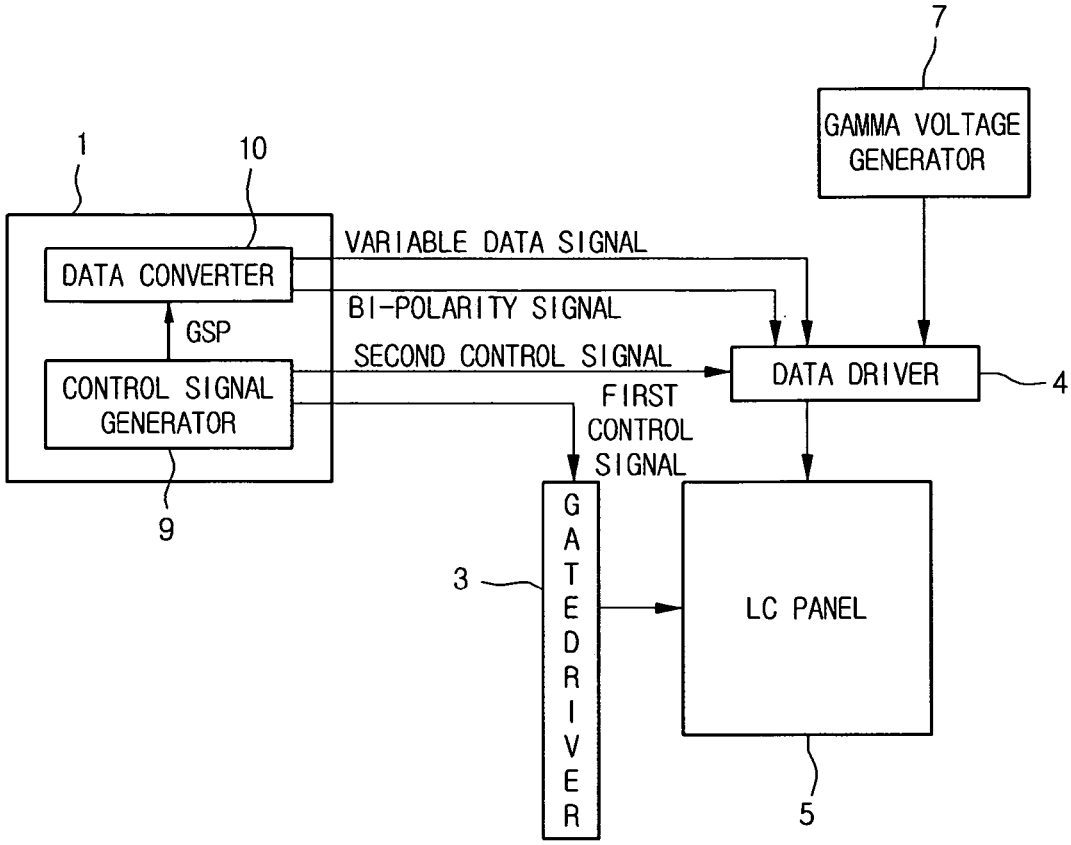
FIG. 7 is a block diagram illustrating a construction of an LCD device according to one embodiment of the present invention.
Figure 8:
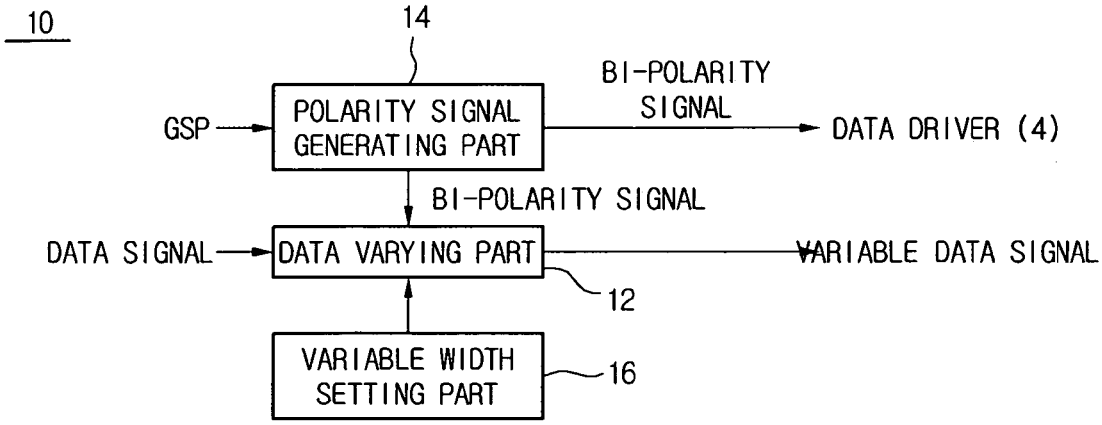
FIG. 8 is a view illustrating in detail the data converting unit of FIG. 7.
Figure 9:
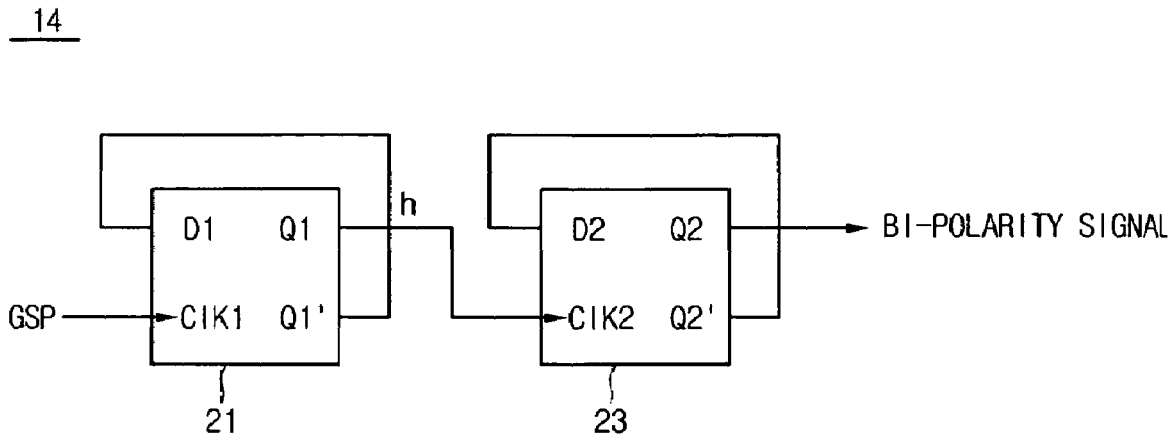
FIG. 9 is a view illustrating a logic circuit diagram of the polarity signal generating part of FIG. 8.

FIG. 7 is a block diagram illustrating a construction of an LCD device according to one embodiment of the present invention, FIG. 8 is a view illustrating in detail the data converting unit of FIG. 7, and FIG. 9 is a view illustrating a logic circuit diagram of the polarity signal generating part of FIG. 8.

Referring to FIG. 7, the LCD device includes a control unit 1, a gate driver 3, a data driver 4, a gamma voltage generator 7, and an LC panel 5.

The control unit 1 includes a control signal generator 9 and a data converter 10.

Image signals (referred to as data signals) of an interlace type including an odd field and an even field are supplied, for example, from an external graphic card (not shown) to the control unit 1. Actual pixel data exist on only odd horizontal lines in the odd field, and any pixel data do not exist on adjacent even horizontal lines. Actual pixel data exist on only even horizontal lines in the even field, and any pixel data do not exist on adjacent odd horizontal lines. In this case, since any pixel data do not exist on the even horizontal lines in the odd field, and the odd horizontal lines in the even field, when corresponding image signals are directly supplied to the LC panel 5, any image is not displayed on the horizontal lines in each field where the pixel data do not exist, so that a complete image cannot be obtained.

Accordingly, the control unit 1 generates dummy pixel data on the even horizontal lines using the actual pixel data on the odd horizontal lines in the odd field. The control unit 1 generates dummy pixel data on the odd horizontal lines using the actual pixel data on the even horizontal lines in the even field.

For example, the dummy pixel data can be generated using an average value of adjacent actual pixel data.

Accordingly, since pixel data exist on both the odd horizontal lines and the even horizontal lines in each field, each field constitutes one frame. Therefore, the actual pixel data and the dummy pixel data on the respective horizontal lines in each field are sequentially displayed on the LC panel 5. Consequently, each field corresponds to one frame according to the present invention.

Though not shown, the control unit 1 further includes means or a unit for generating the dummy pixel data of each field.

It is assumed that both actual pixel data on odd horizontal lines in an odd field, and actual pixel data on even horizontal lines in an even field have the same gray scale for convenience in description according to the present invention. In this case, dummy pixel data on even horizontal lines that are generated from the actual pixel data on the odd horizontal lines in the odd field have the same values as those of the actual pixel data on the odd horizontal lines. Likewise, dummy pixel data on odd horizontal lines that are generated from the actual pixel data on the even horizontal lines in the even field have the same values as those of the actual pixel data on the even horizontal lines. As a result, pixel data on the respective lines in the odd field have the same values as those of pixel data on the respective lines in the even field.

The control signal generator 9 generates a first control signal for driving the gate driver 3 and a second control signal for driving the data driver 4. The first control signal includes signals such as a gate start pulse (GSP) signal, a gate shift clock (GSC) signal, and a gate output enable (GOE) signal, and the second control signal includes signals such as a scan start pulse (SSP) signal, a scan shift clock (SSC) signal, and a scan output enable (SOE) signal.

The GSP signal of the first control signals is supplied to the data converter 10. The GSP signal is generated by one time per frame and informs start of one frame. Since each field corresponds to one frame according to the present invention, the GSP signal is generated every field and supplied to the data converter 10.

Referring to FIG. 8, the data converter 10 includes a polarity signal generating part 14, a variable width setting part 16, and a data varying part 12.

Referring to FIG. 9, the polarity signal generating part 14 includes a first D-flipflop 21 and a second D-flip-flop 23 connected to the first D-flipflop 21.

The first D-flipflop 21 outputs a value of a first input terminal D1 to the second D-flipflop 23 via a first non-inverting terminal Q1 in response to the GSP signal. As described above, the GSP signal can be repeatedly generated at the control signal generator 9 by a field (an even field or an odd field) unit. The second D flipflop 23 outputs a value of a second input terminal D2 via a second non-inverting terminal Q2 in response to a value output via the first non-inverting terminal Q1 of the first D-flipflop 21. When high levels are output via the first and second non-inverting terminals Q1 and Q2, low levels are output via first and second inverting terminals Q1' and Q2'. Therefore, the first inverting and non-inverting terminals Q1' and Q1, and the second inverting and non-inverting terminals Q2' and Q2 can output values having phases inverted with respect to each other, respectively.

Figure 10:
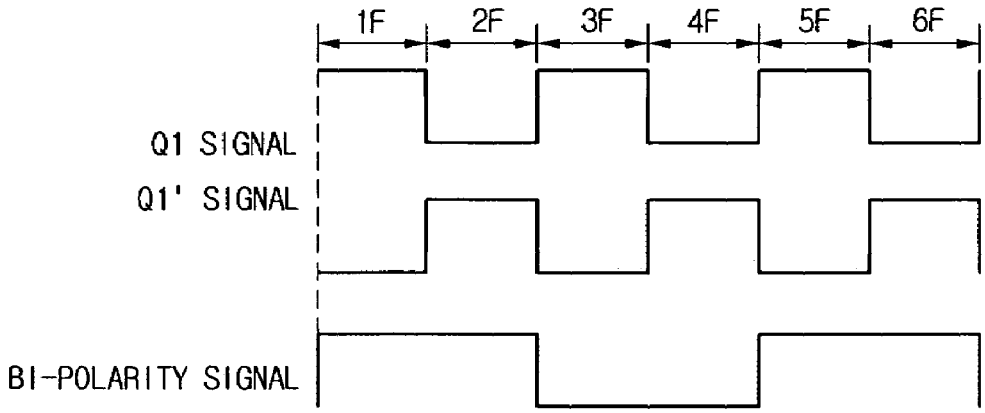
FIG. 10 is a view illustrating a waveform of the polarity signal generating part of FIG. 8.

The above operation will be described in detail with reference to FIG. 10. First, a first GSP signal of a high level is input to the first D flipflop 21 during a first field period (1F, a first odd field period). The first D-flipflop 21 outputs a voltage of the first inverting terminal Q1' to the first non-inverting terminal Q1 in response to the first GSP signal of the high level. It is assumed that a high level is output to the non-inverting terminal Q1. In this case, the first inverting terminal Q1' maintains a low level. The second D-flipflop 23 outputs a voltage of the second non-inverting terminal Q2 to the second inverting terminal Q2' in response to the high level signal of the first non-inverting terminal Q1 of the first D-flipflop 21. It is assumed that a high level signal is output to the non-inverting terminal Q1. In this case, the first inverting terminal Q1' maintains a low level.

A second GSP signal of a high level is input to the first D flipflop 21 during a second field period (2F, a first even field period). A voltage of the first inverting terminal Q1' is output to the first non-inverting terminal Q1 of the first D-flipflop 21 in response to a second GSP signal. Since the first inverting terminal Q1' maintains a low level, a low level is output to the first non-inverting terminal Q1. In this case, the second D-flipflop 22 maintains a previous level. Accordingly, the second non-inverting terminal Q2 of the second D-flipflop 22 maintains a high level, and the second inverting terminal Q2' maintains a low level.

A third GSP signal of a high level is input to the first D-flipflop 21 during a third field period (3F, a second odd field period). A voltage of the first inverting terminal Q1' is output via the first non-inverting terminal Q1 of the first D-flipflop 21 in response to the third GSP signal. Since the first inverting terminal Q1' maintains a high level, a high level is output via the first non-inverting terminal Q1. The high level output from the first non-inverting terminal Q1 of the first D-flipflop 21 is input to the second D-flipflop 22. In this case, a voltage of the second inverting terminal Q2' is output via the second non-inverting terminal Q2 of the second D-flipflop 22. Since the second inverting terminal Q2' maintains a low level, a low level is output via the second non-inverting terminal Q2. In this case, the second inverting terminal Q2' maintains a high level.

A fourth GSP signal of a high level is input to the first D-flipflop 21 during a fourth field period (4F, a second even field period). A voltage of the first inverting terminal Q1' is output via the first non-inverting terminal Q1 of the first D-flipflop 21 in response to the fourth GSP signal. Since the first inverting terminal Q1' maintains a low level, a low level is output via the first non-inverting terminal Q1. The low level output from the first non-inverting terminal Q1 of the first D-flipflop 21 is input to the second D-flipflop 22. In this case, the second D-flipflop 22 maintains a previous level. Accordingly, the second non-inverting terminal Q2 of the second D-flipflop 22 maintains a low level, and the second inverting terminal Q2' maintains a high level.

From the foregoing, the polarity signal generating part 14 can generate a high level and a low level in turns repeatedly by a two-field period unit (e.g., a first odd field period and a first even field period). In other words, the polarity signal generating part 14 generates a bi-polarity signal by a two-field period unit.

Therefore, the polarity signal generating part 14 generates bi-polarity signals whose polarities have been inverted by a two-field unit to supply the bi-polarity signals to the data driver 4 and the data varying part 12.

Consequently, the polarity signal generating part 14 generates bi-polarity signals each having a high level or a low level by a two-field unit using the GSP signal. For example, a bi-polarity signal of a high level can be generated during a first two-field period (i.e., a first odd field period and a first even-field period). Also, a bi-polarity signal of a low level can be generated during a next two-field period (i.e., a second odd field period and a second even field period). After that, a high level and a low level are generated in turns repeatedly by a two-field unit. Therefore, respective fields within the two-field period have the same level.

Though the above description has been limited to the bi-polarity signal for convention in explaining the disclosed embodiments, the polarity signal generating part 14 can expand this concept to generate n-polarity signals. In this case, a high level and a low level can repeatedly be generated in turns by an n-field unit.

Figure 1A:
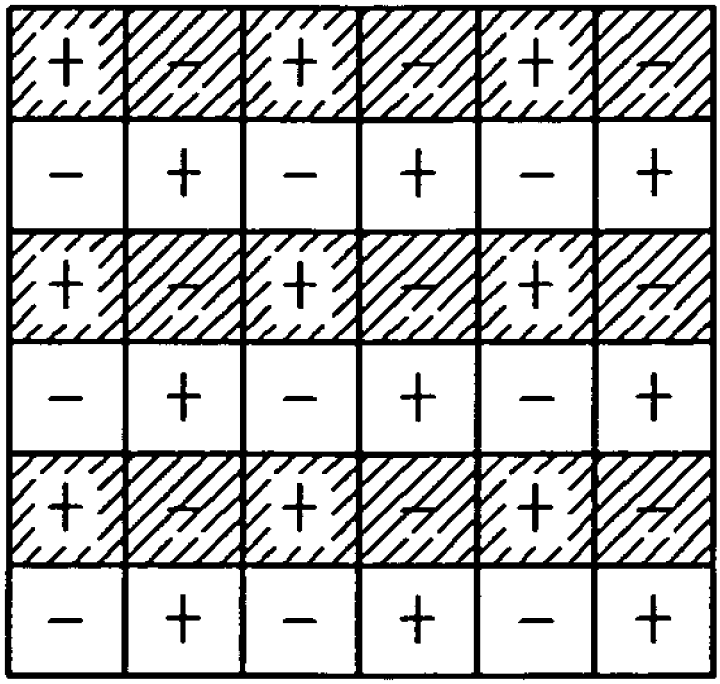
FIG. 1A (RELATED ART)
FIG. 1A is a view illustrating pixel data in an odd field supplied using an interlace type is displayed on an LC panel.
Figure 1B:
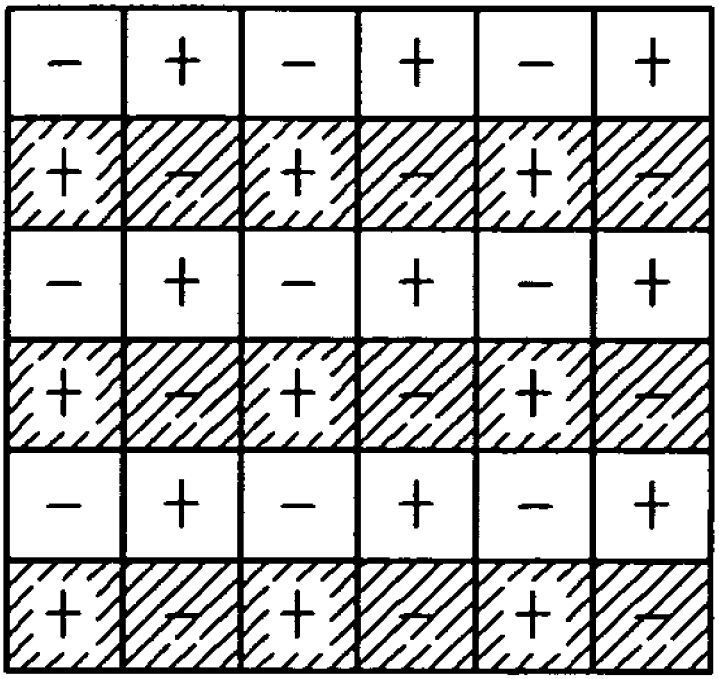
FIG. 1B (RELATED ART)
FIG. 1B is a view illustrating pixel data in an even field supplied using an interlace type is displayed on an LC panel.
Figure 2:
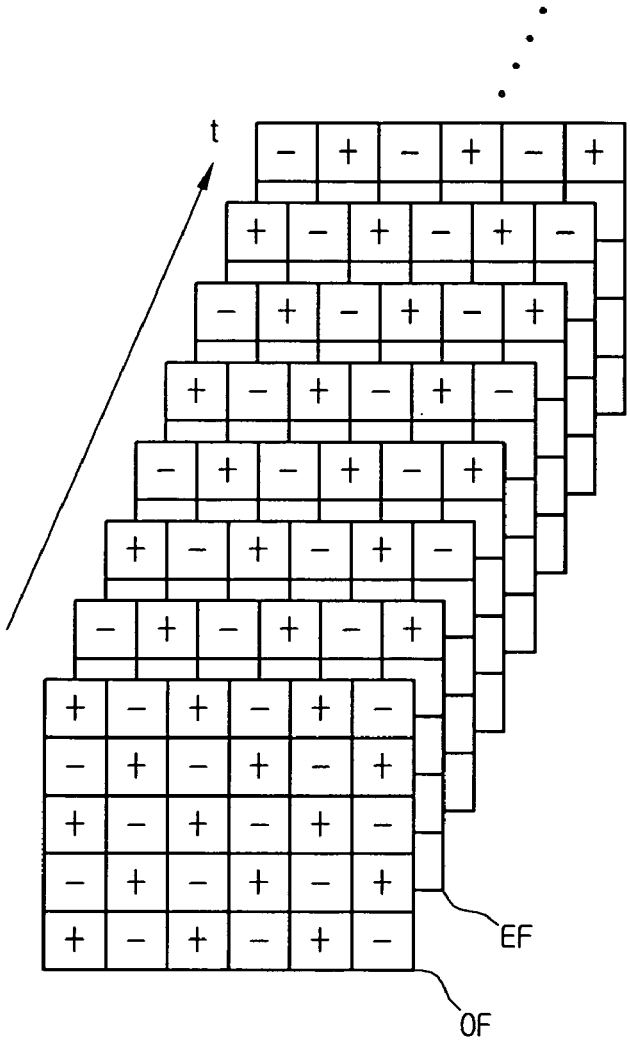
FIG. 2 (RELATED ART)
FIG. 2 is a view illustrating pixel data in each field displayed as a time elapses in a related art LCD device driven in an interlace type.
Figure 3:
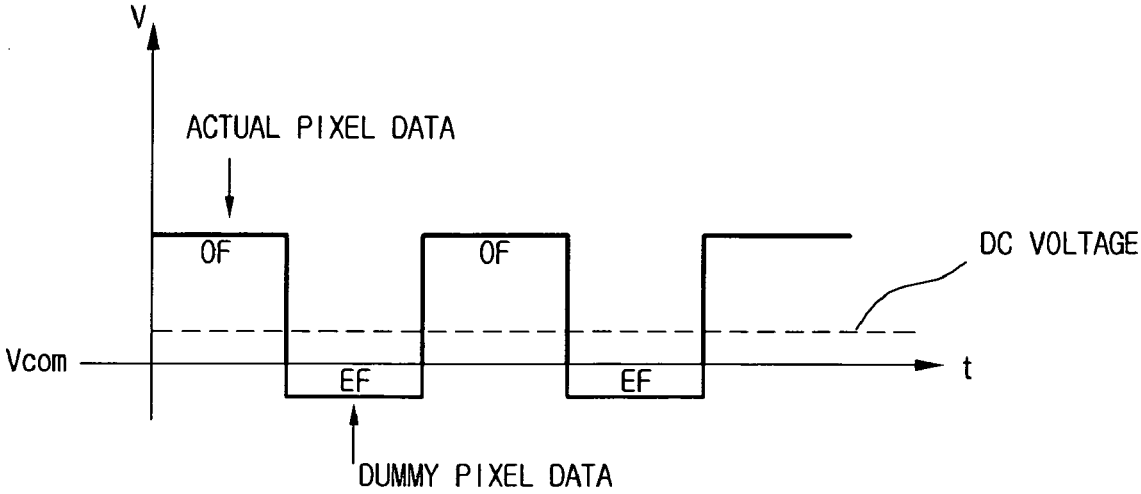
FIG. 3 (RELATED ART)
FIG. 3 is a view illustrating a data change amount versus time in one pixel on the odd horizontal lines illustrated in FIG. 2.
Figure 4:
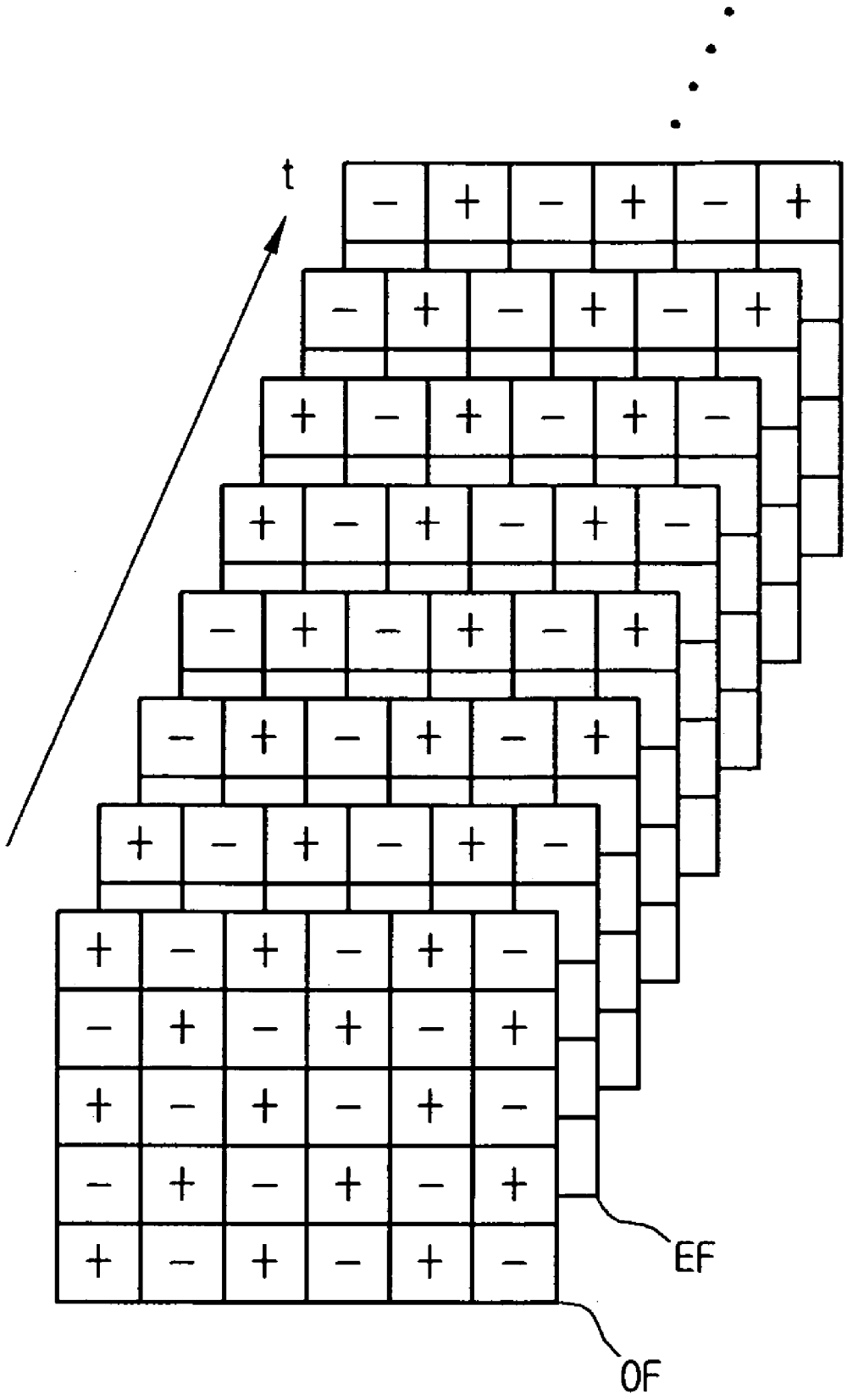
FIG. 4 (RELATED ART)
FIG. 4 is a view illustrating pixel data in each field displayed as a time elapses in a related art LCD device driven in an interlace type.
Figure 5:
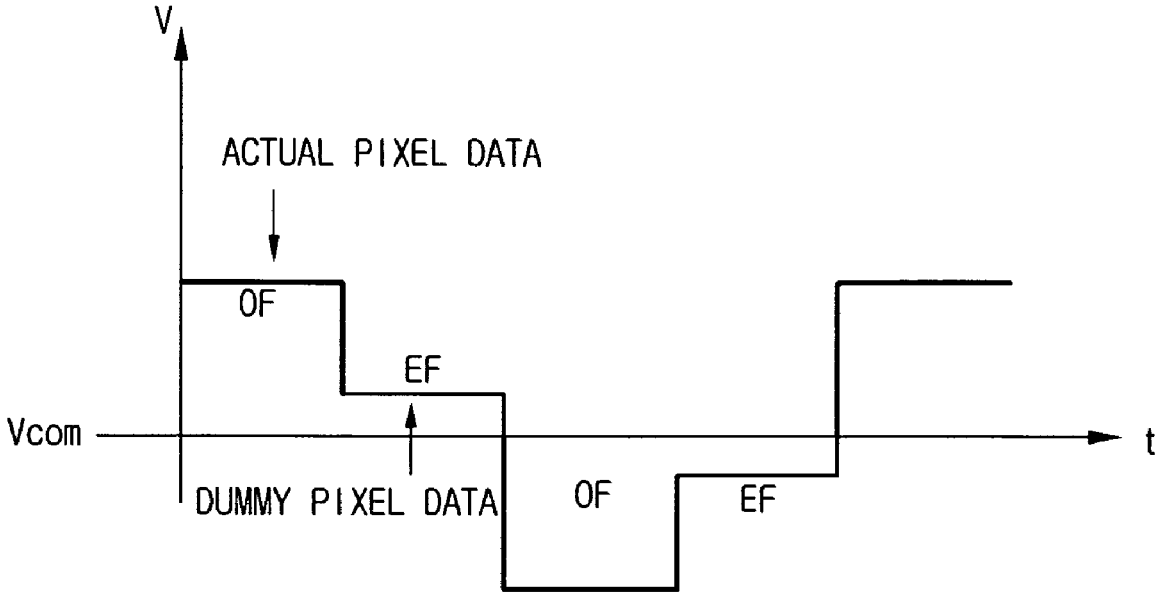
FIG. 5 (RELATED ART)
FIG. 5 is a view illustrating a data change amount versus time in one pixel on the odd horizontal lines illustrated in FIG. 4.
Figure 6:
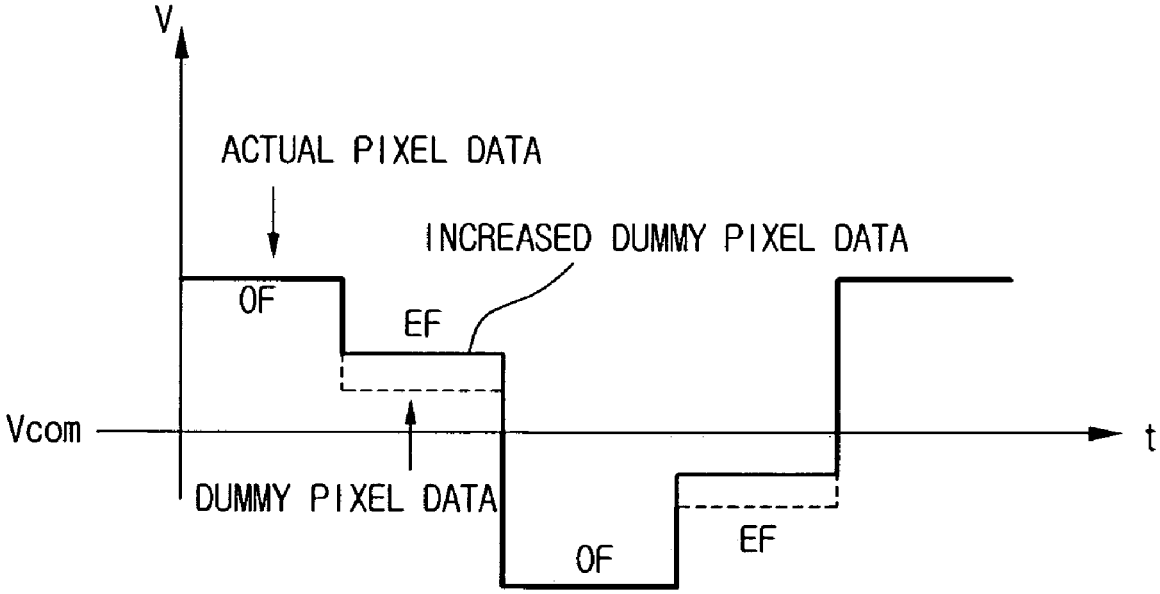
FIG. 6 (RELATED ART)
FIG. 6 is a view explaining flicker generation in the related art LCD device of FIG. 4.

The above-generated bi-polarity signal is supplied to the data driver 4 and inverts polarity of a data signal by a two-field unit to display the inverted data signal on the LC panel 5. In this case, referring to FIG. 6, positive polarity (+) actual pixel data and positive polarity (+) dummy pixel data during first two field periods are canceled by negative polarity (−) actual-pixel data and negative polarity (−) dummy pixel data during next two field periods. Even after that, data are canceled by a two-field unit. Therefore, since an average value (DC voltage) of all of these data is almost zero, an afterimage is not generated.

However, data of the same polarity is generated by a two-field unit. Actual pixel data is provided during an odd field, and dummy pixel data is provided during an even field, in which the dummy pixel data has the same polarity as the actual pixel data. Hence, a DC voltage is not sufficiently discharged during an even field period and remains. The residual DC voltage is added to the supplied dumpy pixel data to display a higher gray scale as much as a DC voltage than the dumpy pixel data. Accordingly, flicker is generated during an even field period of a two-field unit.

Therefore, a variable width setting part 16 and a data varying part 12 are provided in order to solve this problem.

The variable width setting part 16 sets a variable width regarding a degree by which a data signal supplied from the graphic card is varied. The variable width can be changed by an external operator.

The variable width includes a first variable width a for varying a data signal during an odd field period of a two-field unit, and a second variable width β for varying a data signal during an even field period.

A data signal corresponding to each field can include actual pixel data on odd horizontal lines and dummy pixel data on even horizontal lines, or include actual pixel data on even horizontal lines and dummy pixel data on odd horizontal lines.

It is assumed that all of actual pixel data in an odd field and actual pixel data in an even field have the same gray scale according to the present invention. Accordingly, all of actual pixel data on odd horizontal lines in an odd field, dummy pixel data on odd horizontal lines, dummy pixel data on even horizontal lines, and actual pixel data on even horizontal lines in an even field have the same gray scale.

For example, it is assumed that all of the above-mentioned pixel data have a sixty-eight gray scale consisting of eight bits of (01000100).

Therefore, both actual pixel data and dummy pixel data in an odd field are varied by a first variable width α, and both actual pixel data and dummy pixel data in an even field are varied by a second variable width β.

As described above, bi-polarity signals generated by the polarity signal generating part 14 is supplied to not only the data driver 4 but also the data varying part 12.

The data varying part 12 varies a data signal in each field in response to a bi-polarity signal supplied from the polarity signal generating part 14.

Since a bi-polarity signal is used in the present invention, polarity is inverted by a two-field unit. That is, positive polarity (+) data are generated during a first odd field period and a first even field period, and negative polarity (−) data are generated during a second odd field period and a second even field period. Likewise, positive polarity (+) data are generated again during a third odd field period and a third even field period, and negative polarity (−) data are generated during a fourth odd field period and a fourth even field period. Even after that, polarity of data is inverted in the same way as described above.

In the case where an n-polarity signal is used, polarity can be inverted by an n-field unit. In this case, positive polarity (+) data are generated during all field periods within a first n-field period, and negative polarity (−) data are generated during all field periods within a second n-field period.

The data varying part 12 varies a data signal in an odd field by a first variable width a during an odd field period, and varies a data signal in an even field by a second variable width β during an even field period.

It should be noted that in case of a bi-polarity signal, a data signal in an odd field is varied by a first variable width a during an odd field period, and a data signal in an even field is varied by a second variable width β during an even field period regardless of polarity of data.

In the case where a tri-polarity signal is used, a data signal can be varied in a different way. Since polarity is inverted by a three-field unit in case of a tri-polarity signal, each of three fields should be varied. Accordingly, three variable widths (e.g., a first, a second, and a third variable width α, β, and γ) should be set. Therefore, a data signal can be varied using the first to third variable widths during a first to a third field period α, β, and γ, respectively.

When description is made with a limitation to the bi-polarity signal, the first and second variable widths a and β can be the same or different from each other.

For example, the first variable width a can have a gray scale of 0 (00000000), and the second variable width β can have a gray scale of 4 (00000100). Also, both the first and second variable widths α and β can have a gray scale of 4 (00000100).

It is important that a data signal in an even field is reduced by a second variable width β during an even field period of the two-field period. In this case, a data signal in an odd field can be maintained constant (the first variable width α=gray scale 0) or can increase by the first variable width (the first variable width α=gray scale 4) during an odd field period depending on a set value of the first variable width α.

Therefore, in the case where a data signal has a gray scale of 68, the data signal reduces by a second variable width (β=4) during an even field period and becomes a data signal having a gray scale of 64. When the first variable width α is a gray scale 0, the data signal having the gray scale of 68 is not varied and maintained constant. On the other hand, when the first variable width α is a gray scale of 4, which is the same as the second variable width β, the data signal having the gray scale of 68 can increase to a data signal having a gray scale of 72.

Meanwhile, in case of more than tri-polarity signal, a data signal is maintained constant or increases during only a first field period, and data signals corresponding to respective fields in the other field periods can reduce by predetermined variable widths. At this point, reduction widths of the data signals corresponding to the respective fields can be same or can reduce by a larger variable width as time elapses.

The gate driver 3 sequentially supplies scan signals to the LC panel 5 in response to a first control signal output from the control signal generator 9. The number of scan signals corresponding to the number of horizontal lines provided in the LC panel 5 can be generated. All of the scan signals corresponding to the number of horizontal lines provided in the LC panel 5 should be generated within respective field periods and supplied to the LC panel 5. Therefore, each horizontal line of the LC panel 5 is activated one time every field period.

The data driver 4 inverts, by a two-field unit, polarity a variable data signal output from the data varying part 12 and output the variable data signal whose polarity has been inverted in response to a bi-polarity signal output from the polarity signal generating part 14. That is, an analog voltage having positive polarity (+) and an analog voltage having negative polarity (−) are output by a two-field unit.

The data driver 4 reflects a gamma voltage supplied from the gamma voltage generator 7 in response to the bi-polarity signal to output the variable data signal as a corresponding analog voltage.

For example, in the case where a positive polarity (+) gamma voltage has a value in the range of 4-8 V, and a negative polarity (−) gamma voltage has a value in the range of 0-4 V, the gamma voltage generator 7 can generate an analog voltage using the positive polarity (+) gamma voltage with respect to a positive polarity (+) data signal, and generate an analog voltage using the negative polarity (−) gamma voltage with respect to a negative polarity (−) data signal. In this case, a gamma voltage of 4 V means a gray scale of 0 representing "black", a gamma voltage of 8 V means a gray scale of 256 representing "white" of positive polarity (+), and a gamma voltage of 0 V means a gray scale of 256 representing "white" of negative polarity (−). Therefore, the gamma voltages are symmetrical with respect to 4 V depending on polarities (+) and (−). When a gray scale 68 of positive polarity (+) is 4.7 V, a gray scale 68 of negative polarity (−) is 3.3 V.

According to the disclosed embodiments, a data signal having a gray scale of 68 is maintained constant by the data varying part 12 during an odd field period (a first variable width α=a gray scale of 0), and reduces to a gray scale of 64 during an even field period (a second variable width β=a gray scale of 4). That is, a data signal of a gray scale of 68 is differently varied depending on an odd field period and an even field period.

Figure 11:
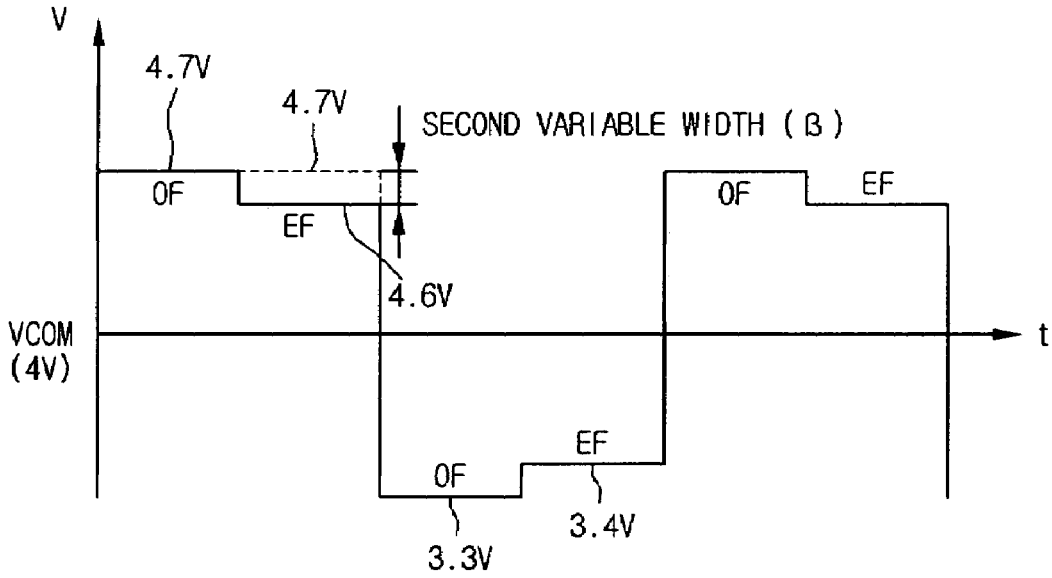
FIG. 11 is a view illustrating an analog voltage supplied to an LC panel as a time elapses.

In this case, referring to FIG. 11, the data driver 4 outputs a data signal having a gray scale of 68 in a first odd field period as an analog voltage of 4.7 V having positive polarity (+), outputs a data signal having a gray scale of 64 in a first even field period as an analog voltage of 4.6 V having positive polarity (+), outputs a data signal having a gray scale of 68 in a second odd field period as an analog voltage of 3.3 V having negative polarity (−), and outputs a data signal having a gray scale of 64 in a second even field period as an analog voltage of 3.4 V having negative polarity (−) in response to a bi-polarity signal.

With the above configuration, a residual DC voltage (about 0.1 V) of an analog voltage of 4.7 V that is not sufficiently discharged during the first odd field period is added to an analog voltage of 4.7 V that has reduced during the first even field period, and consequently, an original analog voltage of 4.7 is obtained, so that the same gray scale can be obtained during the first odd field period and the first even field period. This same gray scale is an originally desired gray scale. As described above, it has been assumed that the same data signal is supplied during the first odd field period and the second even field period. Accordingly, the same gray scale can be actually obtained in the LC panel 5 during the first odd field period and the first even field period.

In the case where the data converter 10 of the present invention is not provided, the same analog voltage would be supplied to the LC panel 5 even during the first even field period as during the first odd field period. In this case, a residual DC voltage that has not yet been discharged during the first odd field period is added to the same voltage as an analog voltage in the first odd field during the even field period, and consequently, the same gray scale cannot be obtained on the LC panel 5 during the first odd field period and the first even field period. Accordingly, flicker can be generated during the first even field period. The foregoing can be similarly applied to the second odd field period, the second even field period, the third odd field period, and the third even field period.

The LC panel 5 includes a first substrate, a second substrate, and an LC layer interposed between the first and second substrates.

For example, in case of a twisted nematic (TN) mode LC panel, the first substrate includes a plurality of horizontal lines and a plurality of vertical lines perpendicularly intersecting, a plurality of thin film transistors (TFTs) connected to the horizontal lines, and a plurality of pixel electrodes connected to the plurality of TFTs. Pixels are defined by the horizontal lines and the vertical lines. One pixel includes one TFT and one pixel electrode.

The second substrate includes red (R), green (G), and blue (B) color filters formed in regions corresponding to the pixels, a black matrix (BM) formed between the color filters, and a common electrode for supplying a common voltage to the color filters and the BM. The present invention can be applied in the same way to other mode LC panels (e.g., a vertical alignment (VA) mode LC panel, an optically compensated bend (OCB) mode LC panel, and an in-plane switching (ISP) mode LC panel) as well as a TN mode LC panel.

In operation, a predetermined data signal is supplied to the data converter 10, and predetermined synchronization signals (e.g., a vertical synchronization signal Vsync and a horizontal synchronization signal Hsync) are supplied to the control signal generator 9.

The control signal generator 9 generates first control signals (e.g., a GSC signal, a GSP signal, and a GOE signal) and second control signals (e.g., an SSC signal, an SSP signal, and an SOE signal). The first control signals are supplied to the gate driver 3, and the second control signals are supplied to the data driver 4. Also, the GSP signal is supplied to the polarity signal generating part 14 of the data converter 10.

The polarity signal generating part 14 generates a bi-polarity signal having one of a high voltage and a low voltage by a two-field unit to supplies the bi-polarity signal to the data driver 4 and the data varying part 12 of the data converter 10 in response to the GSP signal.

The data converter 10 varies the data signal by a field unit in response to the bi-polarity signal. That is, the data signal is varied by different variable widths during an odd field period and an even field period. For example, the data signal is maintained constant during the odd field period, and can reduce during the even field period.

The above-reduced data signal is supplied to the data driver 4.

Meanwhile, the gate driver 3 sequentially supplies scan signals to the LC panel 5 in response to the gate control signal. Accordingly, the plurality of horizontal lines of the LC panel 5 are activated.

The data driver 4 converts the variable data signal into an analog voltage that has reflected a corresponding gamma voltage to supply the converted data signal to the LC panel 5.

Accordingly, an analog voltage lower than an original voltage with consideration of a residual DC voltage that has not yet been discharged during an odd field period is supplied to the LC panel 5 during an even field period, so that flicker that has been generated during the even field period can be removed.

According to a related art, since a data signal has the same positive polarity (+) during both the odd field period and the even field period, a residual DC voltage during the odd field period is added to the α data voltage during the even field period, and thus a more than a desired gray scale is realized and flicker is generated.

The disclosed devices and methods are proposed in order to prevent the flicker that has been generated in related art. Referring to FIG. 11, the present invention can obtain a desired gray scale during an even field period and thus prevent flicker generation by varying a data signal (in the case where the data signal has the same polarity by a two-field unit) before the data signal is supplied to a data driver 4, that is, maintaining the data signal constant or increasing the data signal during an odd field period, reducing the data signal during an even field period, and displaying an image using this variable data signal.

Though the above descriptions have been made with limitation to a bi-polarity signal, the present invention is not limited thereto but can be applied in the same way to at least more than a bi-polarity signal, that is, an n-polarity signal.

As described above, the present invention allows interlace type data signals to be directly applied to an LCD device.

The disclosed embodiments can consider a residual DC voltage applied from a previous field by maintaining or increasing a data signal during a first field period of at lest two-field period having the same polarity, reducing the data signal during a second field period or more (a second, a third, a fourth period . . . ). Therefore, the disclosed embodiments can basically prevent flicker generation during a second field period or more, and thus improve image quality.

Since a data signal having the same polarity is inverted by at least two-field unit, actual pixel data and dummy pixel data having positive polarity cancel actual pixel data and dummy pixel data having negative polarity, so that an entire residual DC voltage becomes zero and thus an afterimage is not generated.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A data converting device comprising:

a polarity signal generating part that generates a polarity signal inverting polarities of data signals in turns by a period of at least two fields;

a data varying part that differently varies the levels of the data signals corresponding to respective field periods within the period of the at least two fields;

a variable width setting part setting a plurality of variable levels that differently varies the levels of the data signals corresponding to the respective field periods, and wherein the plurality of variable levels are different in gray scale, and wherein a first data signal varies by a first variable level during a first field period of the at least two-field period, and a second data signal varies by a second variable level during a second field period to remove a residual DC voltage.

2. The data converting device according to claim 1, wherein the signals having different gray scales gradually increase compared to a signal of a first variable level.

3. The data converting device according to claim 1, wherein a first data signal increases by a first variable level during a first field period of the at least two-field period, and a second data signal reduces by a second variable level during a second field period.

4. The data converting device according to claim 1, wherein a first data signal increases by a first variable level during a first field period of the at least two-field period, and respective data signals reduce by a second variable levels during the other field periods including a second field period.

5. The data converting device according to claim 1, wherein a first data signal increases by a first variable level during a first field period of the at least two-field period, and respective data signals differently reduce by different variable levels during the other field periods including a second field period.

6. A data converting method comprising:

generating a polarity signal for inverting polarities of data signals in turns by a period of at least two fields; and differently varying the levels of the data signals corresponding to respective field periods within the period of the at least two fields, and wherein a first data signal varies by a first variable level during a first field period of the at least two-field period, and a second data signal varies by a second variable level during a second field period to remove a residual DC voltage.

7. The data converting method according to claim 6, wherein a first data signal increases by a first variable level during a first field period of the at least field periods, and a second data signal reduces by a second variable level during a second field period.

8. The data converting method according to claim 6, wherein a first data signal increases by a first variable level during a first field period of the at least two-field period, and respective data signals reduce by a second variable level during the other field periods including a second field period.

9. The data converting method according to claim 6, wherein a first data signal increases by a first variable level during a first field period of the at least two-field period, and respective data signals differently reduce by different variable levels during the other field periods including a second field period.

10. A liquid crystal display device comprising:

a data converting unit that differently varies the levels of data signals corresponding to respective field periods within a period of at least two fields in response to a polarity signal for inverting polarity of a data signal in turns by the period of the at least two fields;

a liquid crystal panel including a plurality of first lines and a plurality of second lines arranged in a matrix;

a gate driver that supplies scan signals to the first lines; and a data driver that supplies an analog voltage that corresponds to the differently varied data signals to the second lines, wherein the data converting unit includes, a polarity signal generating part that generates a polarity signal inverting polarities of data signals in turns by a period of at least two fields, a data varying part that differently varies the data signals corresponding to respective field periods within the period of the at least two fields, a variable width setting part setting a plurality of variable levels that differently varies the levels of the data signals corresponding to the respective field periods, and wherein a first data signal varies by a first variable level during a first field period of the at least two-field period, and a second data signal varies by a second variable level during a second field period to remove a residual DC voltage.

* * * * *